US005261135A

United States Patent [19]

Mitchell

[11] Patent Number: 5,261,135

[45] Date of Patent: Nov. 16, 1993

[54] SCREW GUN ROUTER FOR DRYWALL INSTALLATION

[76] Inventor: Brent R. Mitchell, 2669 E. Cantebury La., Salt Lake City, Utah 84121

[21] Appl. No.: 882,860

[22] Filed: May 14, 1992

Related U.S. Application Data

[63] Continuation-in-part of Ser. No. 877,211, May 1, 1992.

[51] Int. Cl.[5] ..... B26B 11/00

[52] U.S. Cl. ..... 7/158; 81/57.22; 173/50; 408/20

[58] Field of Search ..... 7/158, 165, 167; 81/54, 81/57.14, 57.22, , 57.31, 57.36, 177.1, 177.2, 180.1; 173/48, 50; 408/20

[56] References Cited

U.S. PATENT DOCUMENTS

| | | | |
|---|---|---|---|
| 2,963,913 | 12/1960 | Wensloff | 173/50 X |
| 2,976,436 | 3/1961 | Anton | 173/50 |
| 3,351,111 | 11/1967 | Biddle | 81/177.2 X |
| 3,783,955 | 1/1974 | Gill | 81/57.22 X |
| 4,710,071 | 12/1987 | Koehler et al. | 408/20 X |
| 4,833,746 | 5/1989 | Yong | 7/158 X |
| 4,976,173 | 12/1990 | Yang | 7/158 X |
| 5,149,230 | 9/1992 | Nett | 7/158 X |

*Primary Examiner*—James G. Smith
*Attorney, Agent, or Firm*—Terry M. Crellin

[57] ABSTRACT

An improvement is provided in a screw gun used in the drywall installation industry. The improved screw gun has a conventional screw driving head at the forward end of the gun. A drive shaft extends from the motor of the gun, and an access is provided at the forward end of the housing of the screw gun to provide access to the drive shaft. An adapter member is adapted to be received in and withdrawn from the access member. The adapter member has a rotatable cutting tool associated therewith. Rotational motion is transmitted from the drive shaft to the rotatable cutting tool by the adapter member when the adapter member is received in the access member.

5 Claims, 2 Drawing Sheets

SCREW GUN ROUTER FOR DRYWALL INSTALLATION

BACKGROUND OF THE INVENTION

1. Related Application

This is a continuation-in-part application of my copending U.S. patent application Ser. No. 07/877,211, filed May 1, 1992.

2. Field of the Invention

The present invention relates to an adapter device which can be inserted into an access opening in the housing of a screw gun adjacent to the nosepiece or forward drive portion of the screw gun. The screw gun is otherwise conventional having a spring biased clutch at its forward drive end that must be engaged before the screw gun will transmit rotational motion from its motor to its forward, output drive member. The present invention allows an adapter to engage a drive shaft from the motor at the forward drive end of the housing of the screw gun to provide a rotatable cutting or drilling tool located adjacent to the nosepiece of the screw gun in a quick and easy manner thereby eliminating the need for a separate drill or cutting tool.

3. State of the Art

Conventional power tools as used in the drywall industry typically perform only one function. For example, a screw gun is used for inserting screw type fasteners or attachments through the sheets of drywall, and a separate, distinct router is used to cut openings in the drywall panels after they have been attached to their stud supports. Typical screw gun devices are shown in U.S. Pat. Nos. 2,857,997, 2,950,626, 4,159,050 and 4,804,048. Such tools allow the drive member to slip when a desired tightening torque has been attained in the screw type fasteners or attachments being driven through the drywall panels. However, such screw gun tools do not eliminate the need for the operator to carry a router tool in addition to the screw gun.

Generally, heretofore an installer of drywall typically employed a screw gun for securing the drywall to the framework along with a drywall cutout tool or router which is specifically designed for making cutouts in the drywall for electrical boxes, window openings, splices, etc. In U.S. Pat. No. 5,090,545 a modification of a conventional screw gun is disclosed in which a nose cone adapter is fit on the nose cone of the screw gun so that the screw gun can function both as a drive tool and as a drywall cutout device. Unfortunately, to fit on the nose cone of a conventional screw gun, the adapter must be of a size that is awkward in actual use. In addition complex mechanisms are required for activating and transmitting proper speed of rotation to the drive tool. The adapter tool of U.S. Pat. No. 5,090,545 is relatively expensive and cumbersome to use.

4. Objectives

A principal objective of the present invention is to provide a simplified, relatively small, inexpensive adapter for a screw gun which is attachable to the front of the housing of the screw gun for readily converting the screw gun into a router or cutting member and back to a screw gun by merely attaching and removing the adapter in an access provided in the housing of the screw gun.

A further object of the present invention is to provide an adapter for a screw gun which is relatively simple to manufacture, install and operate.

BRIEF DESCRIPTION OF THE INVENTION

The above objectives are achieved in accordance with the present invention by providing a novel adapter for and modification to a screw gun for quickly and easily converting the screw gun into a router or cutting tool useful during installation of drywall panels.

The present invention comprises an improvement in an otherwise conventional screw gun comprising a housing having a drive motor positioned within the housing between the forward end and the backward end thereof. Such a screw gun further includes a driving head or nosepiece that is mounted at the forward end of the housing of the screw gun to be driven by the motor.

The improvement of the present invention comprises an access opening which is provided through the forward end of the housing of the screw gun, with the access opening being adjacent to the drive head or nosepiece of the screw gun, as well as being substantially in alignment with the rotational axis of a drive shaft from the drive motor. An engageable end portion of such a drive shaft extends from the drive motor and is accessible through the access opening.

A removable drive member is provided which is capable of engagement with the access opening by manually grasping the housing of the removable drive member and inserting the end of the housing into the access opening. An elongate, rotatable, extension shaft extends longitudinally through the housing of the removable drive member for free rotation about a longitudinal axis of the extension shaft.

A first end of the extension shaft is accessible at the end of the housing that is inserted into the access opening of the screw gun. The other end of the extension shaft is accessible at the end of the housing projecting from the screw gun when the removable drive member is engaged in the access opening of the screw gun.

Means are provided for engaging the first end of the extension shaft to an end portion of the drive shaft of the screw gun when the removable drive member is manually inserted in the access opening of the screw gun. The other end of the extension shaft is provided with means for mounting a rotatable tool to that end of the extension shaft.

When the adapter of the present invention is attached to the screw gun, the auxiliary tool, such as a router bit attached to the adapter, extends forwardly beyond the driving head or nosepiece of the screw gun. The router tool on the adapter can then be used to cut openings in the drywall panels. The screw gun is easily and quickly converted back to its conventional use by simply removing the adapter from the screw gun.

In a slightly modified embodiment of an improved screw gun in accordance with the present invention, the drive shaft extends from the drive motor of the otherwise conventional screw gun, and an access means is provided at the forward end of the housing of the screw gun. The access means is in axial alignment with the drive shaft of the motor or with an auxiliary drive shaft driven by the main drive shaft of the motor. An end portion of the drive shaft or auxiliary drive shaft is accessible by way of the access means, and a removable attachment member is manually engaged with and disengaged from the access means.

A rotatable drive member is associated with the attachment member, and means are provided for coupling the rotatable drive member to the end portion of the drive shaft or auxiliary drive shaft when the removable attachment member is engaged with the access means. Means are further provided for mounting a rotating tool to the rotatable drive member so that when the removable attachment member is engaged with the access means, the rotating tool extends forward from the forward end of the housing of the screw gun and rotates with the rotatable drive member.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which:

FIG. 1 is a pictorial representation of an improved screw gun in accordance with the present invention showing an adapter member of the present invention in place in an access opening in the front of the housing of the screew gun; and FIG. 2 is a side elevation of the screw gun of FIG. 1 showing a portion of the housing of the screw gun and the adapter member in cross section and with the adapter member further shown in exploded position.

DETAILED DESCRIPTION OF THE ILLUSTRATED EMBODIMENTS

Figure 1:
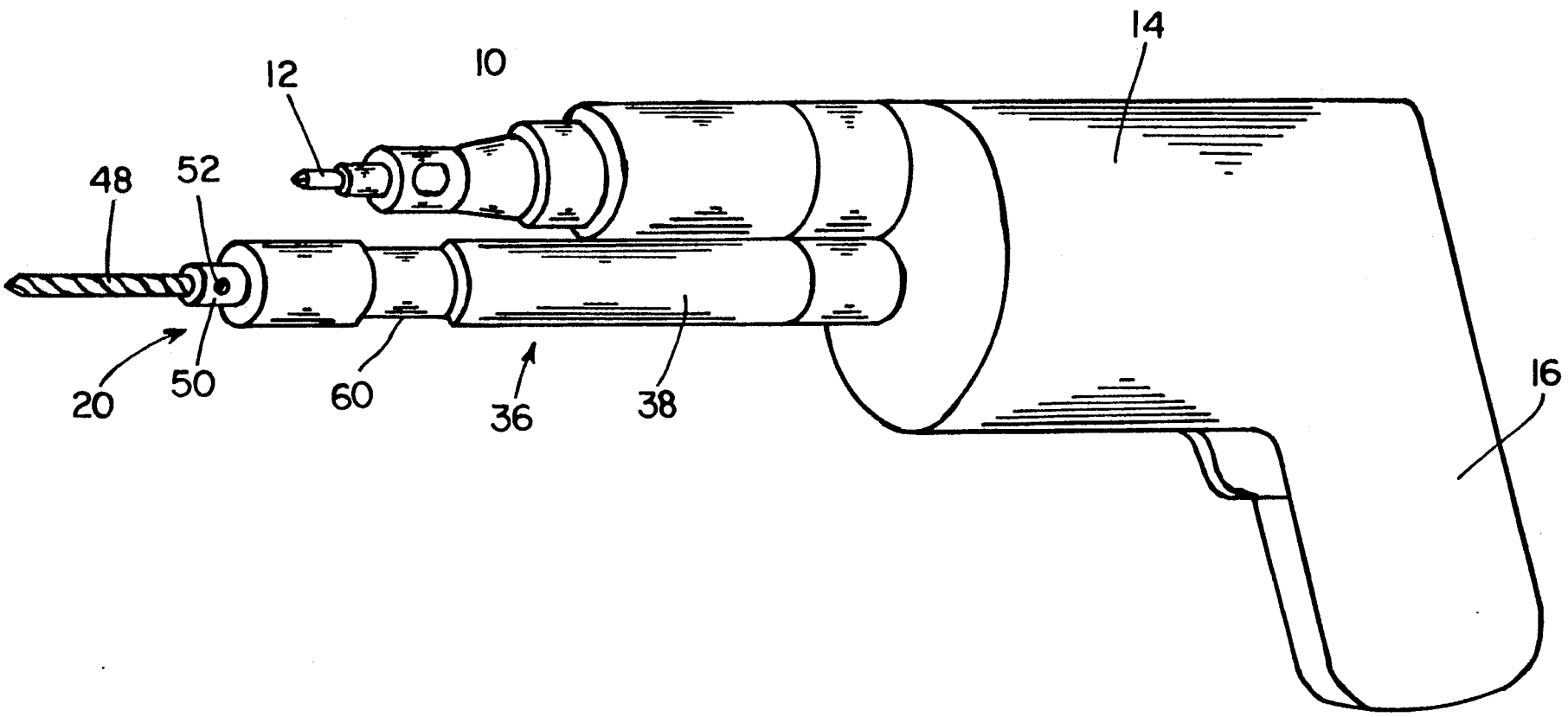

The present invention pertains to novel improvements to an otherwise conventional screw gun as used in the drywall industry. Screw guns are used extensively by those installing drywall panels. Such screw guns have a forward end 10 comprising a nosepiece or screw driving head including a driving bit 12 that is adapted to release a driven screw type fastener when the screw type fastener is inserted to a proper depth in a drywall panel. The conventional screw gun also includes a housing 14 having a handle 16. Further, a drive motor 18 is positioned within the screw gun between the forward end and the backward end of the housing 14. The driving bit 12 is driven through a gear mechanism by the motor 18 as is well known in the art.

The improvement of the present invention relates to an easily used adapter 20 that can be coupled to the drive motor 18 through the forward end of the housing 14 of the screw gun to quickly convert the screw gun into a router or cutting tool that can be used by the drywall installer to cut openings such as for electrical outlets into the installed drywall panels. As mentioned previously, it has been customary for the drywall installer to carry two tools, i.e., a screw gun and a router or cutting tool. The screw gun is used in driving screw type fasteners into the drywall panel as the panel is installed on the stud supports. The router or cutting tool is used to cut openings in the drywall panel. Customarily, the installer is continuously unplugging one tool and plugging in the other tool to an electrical cord. This changing back and forth between tools wastes a considerable amount of time.

In accordance with the present invention an easily used adapter is provided to convert the screw gun into a router or cutting tool. The improvement of the present invention comprises an access means or opening 22 through the forward end of the housing 14 of the screw gun, with the access means 22 being in alignment with a rotational axis of a drive shaft from the motor 18 or an auxiliary drive shaft driven from the main drive shaft from the motor 18. As shown in the drawings, the access means 22 preferably comprises a cylindrical opening formed in the housing 14 of the screw gun.

The cylindrical opening of the access means 22 is in axial alignment with the forward end of the drive shaft 30 of the motor 18. The drive shaft 30 has an engageable forward end portion that extends forwardly from the engagement of the drive shaft with the gear mechanism 32 used for driving the drive bit 12 of the conventional screw gun. The engageable end portion of the drive shaft 30 is accessible through the access opening 22 formed in the forward end of the housing 14 of the screw gun.

A removable drive member 36 comprising a housing 38 having first and second ends is provided. The drive member 36 is capable of engagement with the cylindrical opening that forms the access means 22 by manually grasping the housing 38 and inserting the first end thereof into the cylindrical portion of the access means 22. The first end of the housing 38 is cylindrical in shape and sized to fit snugly within the cylindrical opening of the access means 22.

An elongate, rotatable extension shaft 40 having first and second ends extends longitudinally through the housing 38 of the removable drive member 36. The extension shaft 40 is supported by an appropriate bearing member 42 to freely rotate within the housing 38 about a longitudinal axis of the extension shaft 40. The first end of the extension shaft 40 is accessible at the first end of the housing 38, and the second end of the extension shaft 40 is accessible at the second end of the housing 38.

Means are provided for engaging the first end of the extension shaft 40 to the forward end portion of the drive shaft 30 when the first end of the housing 38 of the removable drive member 36 is manually inserted into the access means 22 in the screw gun. As illustrated in the drawings, the means for engaging the first end of the extension shaft 40 to the drive shaft 30 comprises a pair of complementary male and female engagement means formed at the first end of the extension shaft 40 and the end portion of the rear drive shaft 30, respectively. .

Figure 2:
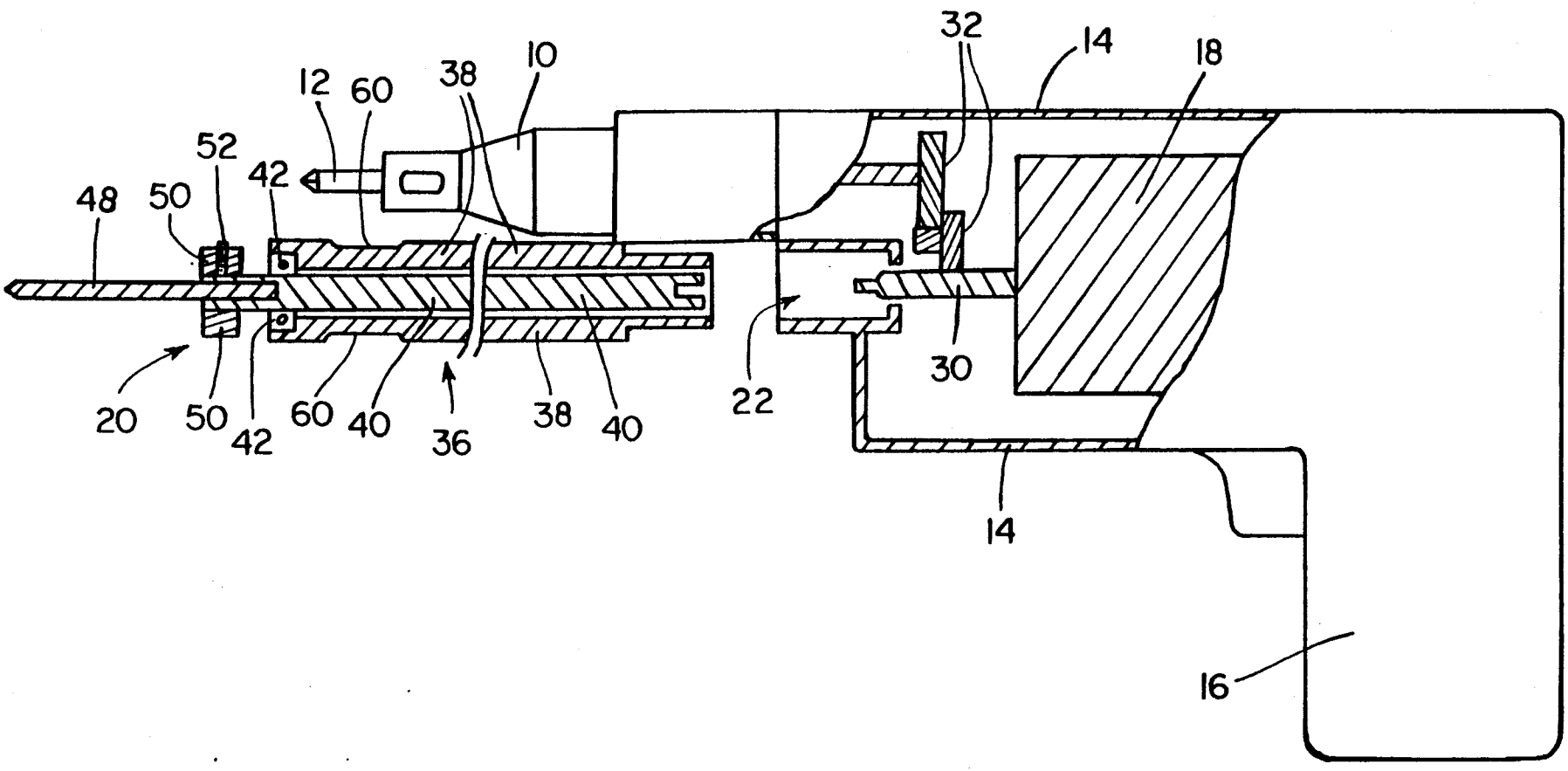

For purposes of the present disclosure, complementary male and female engagement means is meant to include any interengageable means wherein a protuberance on one of the engageable members engages a depression in the other engageable member. As illustrated in FIG. 2, the engagement means comprises an external hex shaped end formed in the protruding end of the drive shaft 30. A hex shaped socket is formed at the first end of the extension shaft 40 which fits easily but snugly over the hex shaped end in the drive shaft 30. The distal end edge of the hex shaped end portion of the shaft 30 can be rounded as is well known in the art so as to facilitate the insertion of the hex shaped end portion into the hex shaped socket of the extension drive shaft 40.

Means are further provided for mounting a rotatable tool, such as a routing drill bit, to the second end of the extension shaft 40. As shown in the drawings, a bore extends inwardly from the second end of the extension shaft 40 to receive the butt end of the drill bit 48. An inwardly directed, planar slit (not shown in the drawings) can be formed in the second end of the extension shaft 40, and a collar 50 having a set screw 52 can be fit around the second end of the extension shaft 40. When the set screw 52 is turned down against the second end of the extension shaft 40, the two pieces of the second end of the extension shaft 40 formed by the planar slit therein are forced toward each other and into tight engagement with the butt end of the drill bit 48.

The housing 38 of the removable drive member 36 preferably has a first cylindrical portion having an inner end spaced inwardly from the first end of the housing 38. This first cylindrical portion has an external diameter that is sufficient to snugly but freely fit within the cylindrical opening of the access means 22. The housing 38 further comprises a second cylindrical portion having a first and second end, with the second cylindrical portion also having a larger outer diameter than the first cylindrical portion. The second cylindrical portion extends from the inner end of the first cylindrical portion to the second end of the housing 38, with the first end of the second cylindrical portion abutting the inner end of the first cylindrical portion forming a circular abutment ring at the inner end of the first cylindrical portion. This abutment ring forms a convenient stop for the housing 38 of the adapter member as it is inserted into the access means 22 in the housing 14 of the screw gun.

An annular recessed groove 60 is conveniently provided in the outer cylindrical surface of the second cylindrical portion of the housing 38 of the removable drive member 36. This groove 60 is of sufficient width to be engageable by an index finger and thumb of the user of the screw gun.

Although preferred embodiments of improvements in a screw gun in accordance with the present invention have been illustrated and described, it is to be understood that the present disclosure is made by way of example and that various other embodiments are possible without departing from the subject matter coming within the scope of the following claims, which subject matter is regarded as the invention.

I claim:

1. In a screw gun having a housing, a nosepiece at the forward end of the housing and a handle at the backward end of the housing, wherein a drive motor is positioned within the housing of the screw gun between the forward end and the backward end thereof, with a screw driving head being mounted at the nosepiece of said screw gun to be driven by said motor, the improvement comprising an access opening through the forward end of said housing, said access opening being in alignment with a rotational drive shaft driven by said drive motor;

an engageable end portion of said drive shaft being accessible through said access opening;

a removable drive member comprising a housing having first and second ends, with said removable drive member being capable of engagement with said access opening by manually grasping said housing and inserting said first end of said housing in said access opening;

an elongate, rotatable extension shaft having first and second ends and extending longitudinally through said housing such that the extension shaft can freely rotate within said housing about a longitudinal axis of said extension shaft, with the first end of said extension shaft being accessible at said first end of said housing and the second end of said extension shaft being accessible at said second end of said housing;

means for engaging said first end of said extension shaft to said end portion of said drive shaft when said first end of said housing of said removable drive member is manually inserted in said access opening in the forward end of said screw gun; and means for mounting a rotatable tool to said second end of said extension shaft.

2. An improvement in a screw gun in accordance with claim 1 wherein the means for engaging said first end of said extension shaft to said end portion of said drive shaft comprises a pair of complementary male and female engagement means formed at the first end of said extension shaft and the end portion of said drive shaft, respectively.

3. An improvement in a screw gun in accordance with claim 1 wherein the housing of said removable drive member comprises a first cylindrical portion having an inner end spaced inwardly from said first end of said housing, with said first cylindrical portion being received within said access opening when said first end of said housing is inserted in said access opening;

a second cylindrical portion having a first and second end, said second cylindrical portion further having a larger diameter than said first cylindrical portion, said second cylindrical portion extending from the inner end of said first cylindrical portion to the second end of said housing, with the first end of said second cylindrical portion abutting the inner end of said first cylindrical portion and forming a circular abutment ring at the inner end of said first cylindrical portion; and an annular, recessed groove in an outer cylindrical surface of said second cylindrical portion, said groove being of sufficient width to be engageable by an index finger and thumb of the user of said screw gun.

4. An improvement in a screw gun in accordance with claim 3 wherein a bearing is positioned within said housing adjacent to the second end of said second cylindrical portion; and said rotatable extension shaft is received through said bearing to freely rotate within said housing.

5. In a screw gun having a housing, a nosepiece at the forward end of the housing and a handle and at the backward end of the housing, wherein a drive motor is positioned within the housing between the forward end and the backward end thereof, with a screw driving head being mounted at the nosepiece of said screw gun to be driven by said motor, the improvement comprising an access means at the forward end of said housing, said access means being in alignment with a rotational drive shaft that is driven by said motor, such that an end portion of said drive shaft is accessible by way of said access means;

a removable attachment member which can be manually engaged with and disengaged from said access means;

a rotatable drive member associated with said attachment member;

means for coupling said rotatable drive member to said end portion of the drive shaft when said removable attachment member is engaged with said access means; and means for mounting a rotating tool to said rotatable drive member such that when said removable attachment member is engaged with said access means, the rotating tool extends away from said backward end of said screw gun and rotates with said rotatable drive member.

* * * * *